US009814643B2

(12) United States Patent
Reid

(10) Patent No.: US 9,814,643 B2
(45) Date of Patent: Nov. 14, 2017

(54) LIFTING APPARATUS AND ASSOCIATED METHODS

(75) Inventor: Joshua Nicholas George Reid, Glasgow (GB)

(73) Assignee: Poolpod Products Ltd., Glasgow (GB)

( * ) Notice: Subject to any disclaimer, the term of this patent is extended or adjusted under 35 U.S.C. 154(b) by 189 days.

(21) Appl. No.: 14/123,366

(22) PCT Filed: May 31, 2012

(86) PCT No.: PCT/GB2012/051230

§ 371 (c)(1),
(2), (4) Date: Jan. 9, 2014

(87) PCT Pub. No.: WO2012/164290

PCT Pub. Date: Dec. 6, 2012

(65) Prior Publication Data

US 2014/0123379 A1 May 8, 2014

(30) Foreign Application Priority Data

Jun. 1, 2011 (GB) ..... 1109188.1

(51) Int. Cl.
*E04H 4/00* (2006.01)
*A61G 7/10* (2006.01)
*A61G 3/06* (2006.01)

(52) U.S. Cl.
CPC ..... *A61G 7/1005* (2013.01); *A61G 3/062* (2013.01); *A61G 3/063* (2013.01); *A61G 7/1017* (2013.01); *A61G 7/1065* (2013.01); *A61G 2203/12* (2013.01); *A61G 2203/16* (2013.01); *A61G 2203/40* (2013.01); *A61G 2203/72* (2013.01); *A61G 2205/60* (2013.01)

(58) Field of Classification Search
CPC ..... A61G 7/1005
USPC ..... 4/496
See application file for complete search history.

(56) References Cited

U.S. PATENT DOCUMENTS 4,712,788 A * 12/1987 Gaudreau, Jr. ..... A63B 22/02 4/496
5,432,961 A 7/1995 Horton
5,836,020 A * 11/1998 Morris ..... A61G 7/1017 4/496

(Continued)

FOREIGN PATENT DOCUMENTS

CN 201453537 U 5/2010
CN 101869522 A 10/2010

(Continued)

OTHER PUBLICATIONS

International Search Report corresponding to PCT/GB2012/051230 dated Feb. 18, 2014.

(Continued)

*Primary Examiner* — Christine Skubinna
(74) *Attorney, Agent, or Firm* — Colby Nipper

(57) ABSTRACT

A lifting apparatus and associated methods for raising a user in a body of water. The lifting apparatus includes a platform configured to receive a wheelchair. The apparatus is reconfigurable between a raised configuration; a lowered configuration; and a storage configuration. The apparatus is configured to maintain the platform in a substantially horizontal orientation in the raised, lowered and storage configurations.

17 Claims, 10 Drawing Sheets

(56) References Cited

U.S. PATENT DOCUMENTS

| | | | | |
|---|---|---|---|---|
| 6,464,097 | B1 | 10/2002 | Arlt et al. | |
| 2006/0101568 | A1 | 5/2006 | Gallan | |
| 2006/0263183 | A1 | 11/2006 | Goodrich | |
| 2007/0118982 | A1 | 5/2007 | Traxler et al. | |
| 2009/0287170 | A1* | 11/2009 | Otto ..... | A61B 5/208<br>604/318 |

FOREIGN PATENT DOCUMENTS

| | | | |
|---|---|---|---|
| DE | 2021838 | U | 11/1971 |
| DE | 3304793 | A1 | 8/1984 |
| DE | 20218382 | U1 | 2/2003 |
| FR | 2833162 | A3 | 6/2003 |
| GB | 2124586 | A | 2/1984 |
| RU | 1771735 | | 10/1992 |
| RU | 1771735 | A1 | 10/1992 |

OTHER PUBLICATIONS

Search Report corresponding to British Application No. GB1109188.1 dated Aug. 30, 2011.

Invitation to Pay Additional Fees and, Where Applicable, Protest Fee corresponding to International Application No. PCT/GB2012/051230 dated Aug. 21, 2012.

Search Report corresponding to Application No. GB 1109188.1 dated Jan. 8, 2015.

* cited by examiner

LIFTING APPARATUS AND ASSOCIATED METHODS

RELATED APPLICATIONS

This application is a 35 U.S.C. §371 national stage application of PCT Application No. PCT/GB2012/051230, filed on May 31, 2012, which claims priority from British Application No. 1109188.1, filed on Jun. 1, 2011, the contents of which are incorporated herein by reference in their entireties. The above-referenced PCT International Application was published as International Publication No. WO 2012/164290 A2 on Dec. 6, 2012.

FIELD OF THE INVENTION

The present invention relates to a lifting apparatus and methods for use in raising or lowering objects; and in particular, but not exclusively to a lifting apparatus with a platform for raising or lowering a wheelchair user, such as into or out of a pool.

BACKGROUND TO THE INVENTION

Swimming pools are often poorly accessible or inaccessible for restricted mobility users via conventional access ladders or steps. Accordingly restricted mobility users are often deterred from using swimming pools. Swimming pool access for restricted mobility users is sometimes provided by lifting devices with slings or chairs used to suspend such users for transfer between the poolside and the pool. The user often requires assistance in getting into, or out of, the sling or chair. For example, the user commonly requires assistance in moving between the wheelchair or crutches and the lifting device. The lifting device is normally controlled at the poolside by an operator; typically by an attendant or a lifeguard.

Once the user is lowered into the water in a seated position on the lifting device, the user dismounts the sling or chair. Usually the operator then raises the sling or chair out of the water until the user wishes to exit the pool. When the user wishes to exit the pool, they signal to the operator to lower the sling or chair into the pool again. Once the user is secured in the sling, the operator raises the sling out of the water and moves the user to the poolside, where the operator normally assists in transferring the user out of the sling.

SUMMARY OF THE INVENTION

According to a first aspect of the present invention there is provided a lifting apparatus for raising and/or lowering a user and/or a wheelchair optionally in a body of water, the lifting apparatus comprising a platform configured to receive a wheelchair, the apparatus being reconfigurable between:

- a raised configuration;
- a lowered configuration; and
- a storage configuration;
- wherein the apparatus is configured to maintain the platform in a substantially horizontal orientation in the raised, lowered and storage configurations.

Providing such a lifting apparatus for raising a user in a body of water with a platform configured to receive a wheelchair may permit a user to be raised in a pool, such as raised out of the pool and transferred to a wheelchair. Providing such a lifting apparatus where the platform is substantially horizontal in each of the configurations may aid confidence in a wheelchair user that the platform is safe to use. The apparatus may permit the user to independently transfer between the wheelchair and the body of water.

The platform may be positioned to be substantially above the body of water in use in the raised configuration.

The platform may be positioned to be substantially submerged in the body of water in use in the lowered configuration.

Providing a platform configured to receive a wheelchair wherein the platform may be substantially submerged in the body of water may permit the user to transfer to/from the wheelchair aided by buoyancy due to the body of water.

The platform may be positioned to be substantially adjacent the body of water in use in the storage configuration.

Providing a storage configuration with the platform positioned to be substantially adjacent the body of water may permit substantially unimpeded use of the body of water, such as unimpeded swimming adjacent the lifting apparatus.

The apparatus may be configured to accommodate an additional apparatus adjacent the apparatus (e.g. on either or both sides of the apparatus on the poolside) in the raised and/or storage and/or lowered configuration/s. For example the additional apparatus may be a second lifting apparatus for raising a user in a body of water.

Providing an apparatus configured to accommodate an additional apparatus adjacent the apparatus may enable multiple apparatus to be used in conjunction. For example, for a swimming competition it may be desired to provide an apparatus in multiple swimming lanes (e.g. an apparatus in each of 8 swimming lanes).

The apparatus may be configured to position the platform directly adjacent the body of water in the storage configuration; such as directly adjacent a point of transition of the platform between poolside and the pool.

The apparatus may be configured to position the platform substantially clear of the body of water in use in the storage configuration (e.g. not above/overlapping the body of water).

The apparatus may be configured to raise the user out of the body of water. The apparatus may be configured to lower the user in the body of water, such as into the body of water. The apparatus may be configured to at least partially submerge the wheelchair and/or the platform.

The apparatus may be configured to maintain the platform in the substantially horizontal orientation during reconfiguration between the raised and lowered configurations.

Providing such a lifting apparatus wherein the platform is substantially horizontal during reconfiguration between the raised and lowered configurations may permit the user to be stably raised or lowered in the wheelchair on the platform.

The apparatus may be configured to move the platform in a similar motion during reconfiguration between the raised and lowered configurations; and/or between the raised and storage configurations; and/or between the lowered and storage configurations. The motion between different configurations may be similarly enabled.

Using a similar motion for reconfiguration between different configurations may enable an increased robustness (e.g. strength) of apparatus; and/or a reduction in the number and/or complexity of components required.

Reconfiguration between the raised and/or the storage and/or the lowered configurations may be achieved using a similar feature/s of the apparatus. For example, the apparatus may comprise a single set of components (e.g. the same set) for reconfiguration between the raised and/or the storage and/or the lowered configurations.

The apparatus may be configured to move the platform between configurations with a single articulation system.

The apparatus may be configured to move the platform along a path between the raised and lowered configurations; and/or between the raised and storage configurations; and/or between the lowered and storage configurations. The path may be a substantially continuous path. The path may be substantially non-linear. The path may be arcuate, such as a portion of a circle. The path may be substantially linear. The path may be defined substantially in a single plane. The plane may be substantially vertical. The path may be substantially between a poolside and pool, such as directly between the poolside and the pool (e.g. in a vertical plane perpendicular to the poolside).

The apparatus may be configured to maintain the platform in a substantially horizontal configuration during reconfiguration between the raised and storage configurations.

The apparatus may be configured to maintain the platform in a forward-facing direction during reconfiguration between the raised and lowered configurations; and/or between the raised and storage configurations; and/or between the lowered and storage configurations. The forward-facing direction may comprise a pool-facing direction during reconfiguration between different configurations (e.g. during reconfiguration from the raised to the lowered configurations and/or from the lowered to the raised configurations). The forward-facing direction may comprise a poolside-facing direction during reconfiguration between different configurations (e.g. during reconfiguration from the lowered to the raised configurations).

Such an apparatus may assist in the prevention of damage and/or accidents: for example, where a user faces directly towards an intended path of the platform (e.g. into the pool) there may be an increased awareness of a potential hazard such as an obstruction and/or another pool user in the intended path.

The apparatus may be configured to prevent rotation of the platform relative to the platform support (e.g. rotation about a vertical and/or a horizontal axis).

The apparatus may be configured to locate the platform in a position vertically over the body of water in the raised configuration.

The apparatus may be configured to locate the platform in a position above the body of water in the storage configuration.

The apparatus may comprise a drive system. The drive system may be configured to reconfigure the apparatus between the raised and lowered configurations; and/or between the raised and storage configurations; and/or between the lowered and storage configurations.

The apparatus may comprise an actuator. The apparatus may comprise a single actuator for reconfiguration between each of the different configurations. Providing a single actuator may reduce cost and/or complexity and/or maintenance and/or weakness of the apparatus. Providing a single actuator may enable manual operation of the apparatus (e.g. via a recovery system, such as in the event of a power failure or failure of the drive system).

The apparatus may further comprise a base configured to be fixed relative to the body of water. The apparatus may be configured to position the platform in substantially a same horizontal plane as the base in the raised configuration. The apparatus may be configured to position the platform in substantially a same horizontal plane as the base in the storage configuration.

The base may be configured to be retrofitted, such as fitted to an existing swimming poolside. For example, the apparatus may be configured to be mounted to a poolside using a fixing/s such as a fixing with a minimal cross-sectional area (e.g. a bolt/s). Using such a fixing/s may ease installation: for example, to install the base may require one or more bolt holes to be drilled poolside, which may be comparatively straightforward compared to for example installing a more substantial support structure such as a pole (e.g. a bolthole may be drilled through an existing tile, rather than require the removal of tile/s and a substantial foundation support). The base may utilise existing fixing points (e.g. boltholes for other pool apparatus, such as springboards, start ramps, lane guides, etc.)

The apparatus may be configured to be manually activated. For example, the apparatus may comprise an on switch. The on switch may be contactlessly operable (e.g. with an electromagnetic signal). The apparatus may comprise a control system for controlling the operation of the apparatus. The apparatus may be configured to be remotely activated, such as with an activation member. The apparatus may comprise an activation sensor for receiving a signal from the activation member. The apparatus may be configured to be automatically activated. The apparatus may be configured to be activated by a proximity of the activation member to the activation sensor. For example the activation member may comprise a RFID element. The activation member may be configured to be transported by the user. For example, the activation member may comprise a wristband. The activation member may be configured to be located in the body of water. For example, the activation member may be substantially water resistant, or waterproof. The apparatus may be configured to be deactivated by a signal from the activation member. For example, the apparatus may be configured to be deactivated by a withdrawal of the activation member from the proximity of the activation sensor.

The apparatus may be configured to allow access to an authorised user only. The apparatus may be configured to prevent access to an unauthorised user. For example, the apparatus may comprise an entrance barrier, such as a door or a gate. The apparatus may be configured to restrict activation to an authorised user. The apparatus may be configured to prevent activation by an unauthorised user. The apparatus may be configured to be transitioned between an inoperable and an operable state. For example, the apparatus may comprise a locking element. The locking element may be configured to prevent activation and/or stop operation of the apparatus. The locking element may be configured to be controlled by an operator. The operator may be a controller, such as a lifeguard. The operator may be the user. The apparatus may be configured to be transitioned from the inoperable to the operable state dependent upon an identity of the user. The apparatus may be configured to be transitioned from the inoperable to the operable state dependent upon an identity of the user. The apparatus may be configured to be transitioned from the inoperable to the operable state dependent upon an approval of the operator. The apparatus may be configured to adopt the inoperable state as a default state. The apparatus may be configured to adopt the operable state as a default state. The locking element may be configured to mechanically lock the platform in position in the inoperable state. The locking element may be configured to prevent drive to the platform in the inoperable state. The locking element may be configured to mechanically lock the platform in position when the apparatus is deactivated. The locking element may be configured to prevent drive to the platform when the apparatus is deactivated. The control system may be configured to prevent drive to platform in the inoperable state.

The apparatus may further comprise a first linkage assembly connecting the platform to the base. The first linkage assembly may comprise first and second link arms. The first link arm may be connected to the base at a first link arm base pivot. The linkage assembly may further comprise a platform support member. The first link arm may be connected to the platform support member at a first link arm platform pivot. The second link arm may be connected to the base at a second link arm base pivot. The second link arm may be connected to the platform support member at a second link arm platform pivot. Accordingly, the first linkage assembly may define four pivot points. The first and second link arms may be substantially parallel. The first linkage assembly may be configured such that the first and second link arms are substantially parallel throughout reconfiguration. The first and second link arms, the platform support and the base may define a four bar mechanism, with the first and second link arms defining opposite sides of a quadrilateral representative of the four bar mechanism. The four pivot points may define a trapezium at one or more of the configurations and/or at at least one stage during reconfiguration. The four pivot points may define a parallelogram at one or more of the configurations and/or at at least one stage during reconfiguration. The four pivot points may define a rectangle at one or more of the configurations and/or at at least one stage during reconfiguration.

The linkage assembly may be configured to maintain the platform support at a same orientation relative to the base throughout reconfiguration.

A distance between the first link arm base pivot and the first link arm platform pivot (e.g. a length of the first link arm) may be substantially the same as a distance between the second link arm base pivot and the second link arm platform pivot (e.g. a length of the second link arm).

A distance between the first link arm platform pivot and the second link arm platform pivot may be substantially the same as a distance between the first link arm base pivot and the second link arm base pivot.

The first linkage assembly may be configured such that the first and second link arms at least partially overlap when viewed in a horizontal plane. The first linkage assembly may be configured to overlap the first and second link arms such that there is no substantial vertical separation between the first and second link arms during reconfiguration between the raised and lowered configurations. The first linkage assembly may be configured to overlap the first and second link arms such that there is no substantial vertical separation between the first and second link arms during reconfiguration between the raised and storage configurations. The first link arm may be positioned in a different vertical plane from the second link arm. The first link arm and the second link arm may be positioned in different vertical planes such that the first and second link arms may overlap horizontally. A first link arm vertical plane may be adjacent a second link arm vertical plane such that there is a minimal horizontal separation between the first and second link arms. The first link arm vertical plane may be adjacent the second link arm vertical plane such that there is a minimal horizontal separation between the first and second link arms during reconfiguration between the raised and lowered configurations. The first link arm vertical plane may be adjacent the second link arm vertical plane such that there is a minimal or no horizontal separation between the first and second link arms during reconfiguration between the raised and storage configurations.

Providing a lifting apparatus with no substantial vertical separation between the first and second link arms may aid in preventing trapping objects, such as body parts, between the first and second link arms. Providing a lifting apparatus with a minimal or no horizontal separation between the first and second link arms may aid in preventing trapping objects, such as body parts, between the first and second link arms.

The apparatus may be configured to position the platform in the storage configuration with the platform substantially aft of a foremost base pivot, such as the first link arm base pivot or the second link arm base pivot, in the storage configuration.

The platform may be fixed relative to the platform support pivots. For example, the platform may be rigidly connected to the platform support. The platform support may comprise the platform.

Providing a platform fixed relative to the platform pivots may aid prevention of unintended rotation of the platform relative to the horizontal. Providing a platform fixed relative to the platform pivots may permit improved robustness of the apparatus. Providing a platform fixed relative to the platform pivots may permit reduced manufacturing complexity and/or costs.

The apparatus may be configured to provide a substantially similar vertical elevation of the platform support member in the raised and storage configurations.

The linkage assembly may be hydraulically actuated.

The linkage assembly may be mechanically actuated.

The linkage assembly may be electrically actuated.

The linkage assembly may be manually actuated.

The linkage assembly may be gravity actuated.

The apparatus may further comprise a first transmission system connected to the linkage assembly. The first transmission system may comprise a rotational transmission system, such as a gearbox. The first and/or second link arm/s may be connected to a first gear, such as a first sprocket. The first and/or second link arm/s may be rigidly connected to the first gear. The first gear may be connected to a second gear, such as a second sprocket. The first gear may comprise a larger diameter than the second gear. The first gear and the second gear may comprise a substantially similar diameter. The first gear may comprise a smaller diameter than the second gear. The first gear may comprise greater number of engagement elements, such as teeth, than the second gear. The first gear and the second gear may comprise a substantially similar number of engagement elements, such as teeth. The first gear may comprise a smaller number of engagement elements, such as teeth, than the second gear. The apparatus may further comprise a drive member connecting the first gear to the second gear. The drive member may comprise a belt. The drive member may comprise a chain. The first transmission system may further comprise a worm drive member. The second gear may comprise a worm gear. The first gear may comprise a worm gear. The first transmission system may comprise a transmission element for angularly translating drive, such as a bevel gear. The transmission element may transmit drive to the worm drive member. The first transmission system may comprise a connecting shaft. The first transmission system may further comprise a pulley. The apparatus may further comprise a motor. The first transmission system may be connected to the first motor.

The apparatus may comprise a second linkage assembly. The second linkage assembly may comprise one or more features analogous to the first linkage assembly. For example, the second linkage assembly may comprise a third link arm and a fourth link arm. The respective third and fourth link arms may comprise one or more features analogous to those of the respective first and second link arms.

The apparatus may be configured to synchronise movement of the first and second linkage assemblies. The apparatus may be configured to synchronise drive to the first and second linkage assemblies.

Synchronising the movement of the first and second linkage assemblies may aid in maintaining the platform in an orientation, such as the substantially horizontal orientation.

The second linkage assembly may be connected to the first linkage assembly. For example, the second linkage assembly may comprise a second transmission system. The second transmission system may be connected to the first transmission system. For example, the lifting apparatus may further comprise a drive element, such as a chain, belt or shaft, connecting the first and second transmission systems. The second transmission system may be connected to the first motor. The apparatus may comprise a second motor connected to the second transmission system. The first and/or second motor/s may be hydraulically driven. The first and/or second motor/s may be electrically driven. The first and/or second motor/s may be fuel driven, such as with combustible fuel (e.g. diesel).

The first platform support may be located at/adjacent a first side portion of the platform. The second linkage assembly may comprise a second platform support. The second platform support may be located in at/adjacent a second side portion of the platform. The second side portion of the platform may be a substantially opposite side of the platform from the first side portion.

The apparatus may be configured to prevent collision of the platform. For example, the apparatus may comprise at least one platform proximity sensor. The platform proximity sensor may be configured to detect an object in a path of the platform, such as an obstacle (e.g. a swimmer under the platform). The platform proximity sensor may be configured to deactivate the apparatus. For example, the platform proximity sensor may be configured to stop the platform moving when the object is detected. The apparatus may be configured to emit an alert signal when the platform proximity sensor detects an object. The alert may be an audio alert. The alert may be a visual alert. The alert may be a haptic alert. The alert may be a remote alert. The apparatus may be configured to move the platform in response to the detection of an object. For example, the apparatus may be configured to move the platform away from the object, such as reversing the movement of the platform.

The apparatus may comprise a linkage assembly proximity sensor. The linkage assembly proximity sensor may be configured to detect an object in an intended path of the linkage assembly, such as between the first and second link arms. The linkage assembly proximity sensor may be configured to deactivate the apparatus. For example, the linkage assembly proximity sensor may be configured to stop the platform moving when the object is detected. The apparatus may be configured to emit an alert signal when the linkage assembly proximity sensor detects an object. The alert may be an audio alert. The alert may be a visual alert. The alert may be a haptic alert. The alert may be a remote alert. The apparatus may be configured to move the platform in response to the detection of an object. For example, the apparatus may be configured to move the platform away from the object, such as reversing the movement of the platform.

The apparatus may be configured to support a standing user during reconfiguration, such as comprising a handle and/or handrail. The apparatus may comprise a seat to support a sitting user during reconfiguration. The seat may be hinged, such as to move between a stored position and a deployed position.

The apparatus may be configured to attach a wheelchair. For example, the apparatus may comprise a securement member to fix the wheelchair to the platform. The securement member may be releasable. The securement member may be configured to engage an attachment member on the wheelchair. The securement member may be configured to mechanically engage the attachment member on the wheelchair. The securement member may be configured to magnetically engage the attachment member on the wheelchair. The securement member may be a fore securement member. The securement member may be a rear securement member. The apparatus may comprise multiple securement members. The entrance barrier may comprise the securement member.

The apparatus may comprise a recovery mechanism. For example, the apparatus may comprise a manual recovery handle to manually activate the first linkage assembly, such as in a failure of a primary drive to the first linkage assembly. The recovery mechanism may be configured to override the primary drive.

The apparatus may be configured to align the wheelchair positioned on the platform. For example, the apparatus may be configured to align the wheelchair substantially squarely on the platform. The apparatus may be configured to align the wheelchair on the platform such that the user is facing a direction of intended travel of the platform. For example, the apparatus may be configured to align the wheelchair facing substantially towards the body of water during lowering. The apparatus may be configured to align the wheelchair facing substantially away from the body of water during raising. The apparatus may be configured to align the wheelchair on the platform such that the user is facing towards the body of water. The apparatus may comprise a wheelchair alignment member. The entrance barrier may comprise the wheelchair alignment member. The apparatus may comprise an exit barrier. The entrance barrier may comprise the exit barrier. For example, the entrance barrier may be configured to contact the wheelchair when the entrance barrier is closed when the wheelchair is positioned on the platform.

The apparatus may comprise a wheelchair sensor to detect a correct positioning of the wheelchair on the platform.

The apparatus may be configured to be inoperable when the wheelchair is not correctly positioned on the platform. The apparatus may be configured to be inoperable when the wheelchair is incorrectly positioned on the platform. The apparatus may be configured such that the entrance barrier cannot be closed with a wheelchair incorrectly positioned on the platform.

The apparatus may be configured to lower multiple users simultaneously.

According to a second aspect of the invention there is provided a method of raising a user in a body of water, the method comprising:

the user accessing a platform of a lifting apparatus in a lowered configuration;

maintaining the platform in a horizontal orientation; and reconfiguring the apparatus to a raised configuration.

The method may comprise at least partially submerging the platform in the lowered configuration.

The method may comprise activating the lifting apparatus with a remote activation member.

The method may comprise the user transferring onto a wheelchair on the platform in the lowered configuration. The method may comprise raising the user out of the body of water. The method may comprise the user exiting the lifting apparatus by wheeling the wheelchair off the platform in the raised configuration. The method may comprise reconfiguring the apparatus to a storage configuration. The method may comprise maintaining the platform in a horizontal orientation during reconfiguration.

According to a third aspect of the invention there is provided a wheelchair for use with a platform of a lifting apparatus, wherein the wheelchair comprises an attachment member configured to engage a securement member on the lifting apparatus.

According to a fourth aspect of the invention there is provided a lifting apparatus for raising a user, the lifting apparatus comprising a platform configured to receive a wheelchair, the apparatus comprising:

a base;

a first linkage assembly connecting the platform to the base, the first linkage assembly comprising first and second link arms and a platform support, each of the first and second link arms connecting the platform support to the base;

wherein the first linkage assembly is configured such that the first and second link arms at least partially overlap when viewed along a horizontal plane.

The first link arm may be connected to the base at a first link arm base pivot. The first link arm may be connected to the platform support member at a first link arm platform pivot. The second link arm may be connected to the base at a second link arm base pivot. The second link arm may be connected to the platform support member at a second link arm platform pivot. Accordingly, the first linkage assembly may define four pivot points. The first and second link arms, the platform support and the base may define a four bar mechanism, with the first and second link arms defining opposite sides of a quadrilateral representative of the four bar mechanism. The quadrilateral may comprise a trapezium at one or more configuration/s during the raising of the user. The quadrilateral may comprise a parallelogram during the raising of the user. The quadrilateral may comprise a rectangle during the raising of the user.

The linkage assembly may be configured to maintain the platform support at a same orientation relative to the base throughout the raising of the user.

The first linkage assembly may be configured to overlap the first and second link arms such that there is no substantial vertical separation between the first and second link arms when raising the user. The first linkage assembly may be configured to overlap the first and second link arms such that there is no substantial vertical separation between the first and second link arms when raising the user. The first link arm may be positioned in a different vertical plane from the second link arm. The first link arm and the second link arm may be positioned in different vertical planes such that the first and second link arms may overlap horizontally. A first link arm vertical plane may be adjacent a second link arm vertical plane such that there is a minimal horizontal separation between the first and second link arms. The first link arm vertical plane may be adjacent the second link arm vertical plane such that there is a minimal horizontal separation between the first and second link arms when raising the user.

Providing a lifting apparatus with no substantial vertical separation between the first and second link arms may aid in preventing trapping objects, such as body parts, between the first and second link arms. Providing a lifting apparatus with a minimal or no horizontal separation between the first and second link arms may aid in preventing trapping objects, such as body parts, between the first and second link arms.

According to a fifth aspect of the invention there is provided a lifting apparatus for raising a wheelchair user, the lifting apparatus comprising a platform configured to receive a wheelchair, the apparatus being reconfigurable between:

a raised configuration;

a lowered configuration; and a storage configuration;

wherein the apparatus is configured to inhibit operation by an unauthorised user.

The apparatus may comprise a control system activateable dependent upon a user identity. For example the apparatus may be activateable with an activation member, such as a remote activation member.

The invention includes one or more corresponding aspects, embodiments or features in isolation or in various combinations whether or not specifically stated (including claimed) in that combination or in isolation. For example, it will readily be appreciated that features recited as optional with respect to one aspect may be additionally applicable with respect to any other aspect, without the need to explicitly and unnecessarily list those various combinations and permutations here. For example, features of the lifting apparatus of the first aspect may be combined with the lifting apparatus of the fourth and/or fifth aspect.

It will be appreciated that one or more embodiments/aspects may be useful in raising or lowering a load, such as a wheelchair user.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
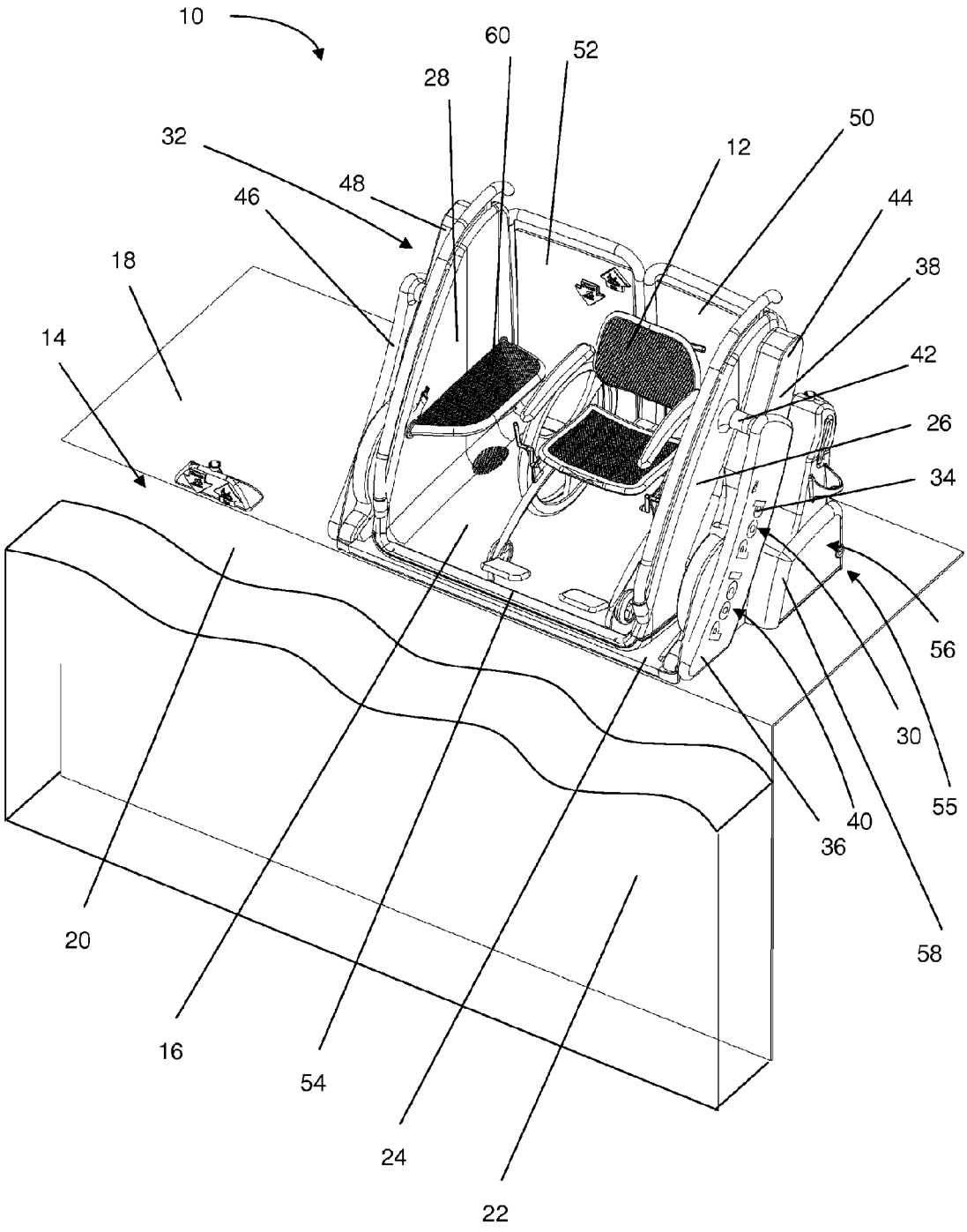
FIG. 1 is a representation of a lifting apparatus for use in raising a user in a wheelchair on a platform in a body of water in accordance with an embodiment of the invention, in a storage configuration.
Figure 2:
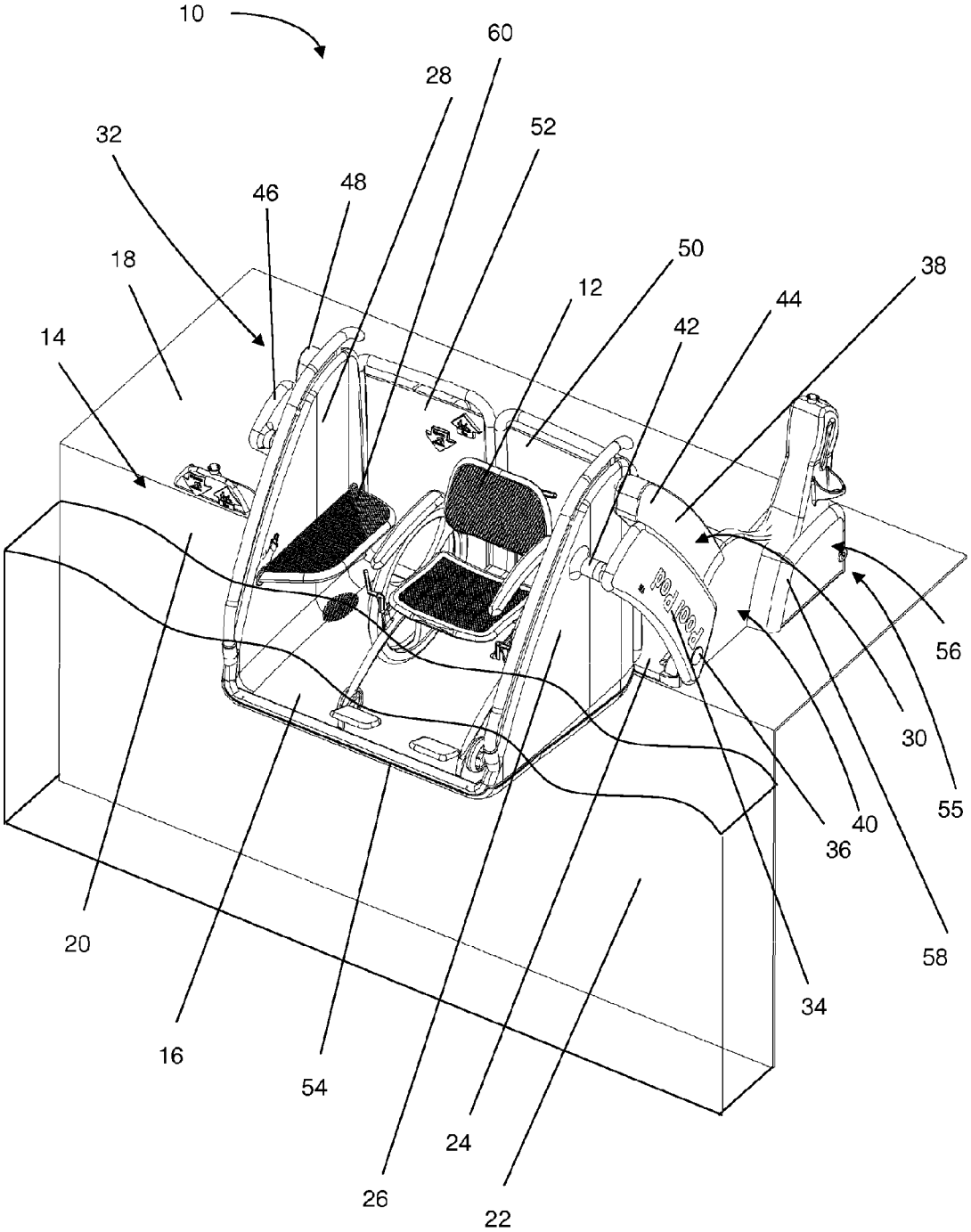
FIG. 2 is a representation of the lifting apparatus of FIG. 1 in a raised configuration.
Figure 3:
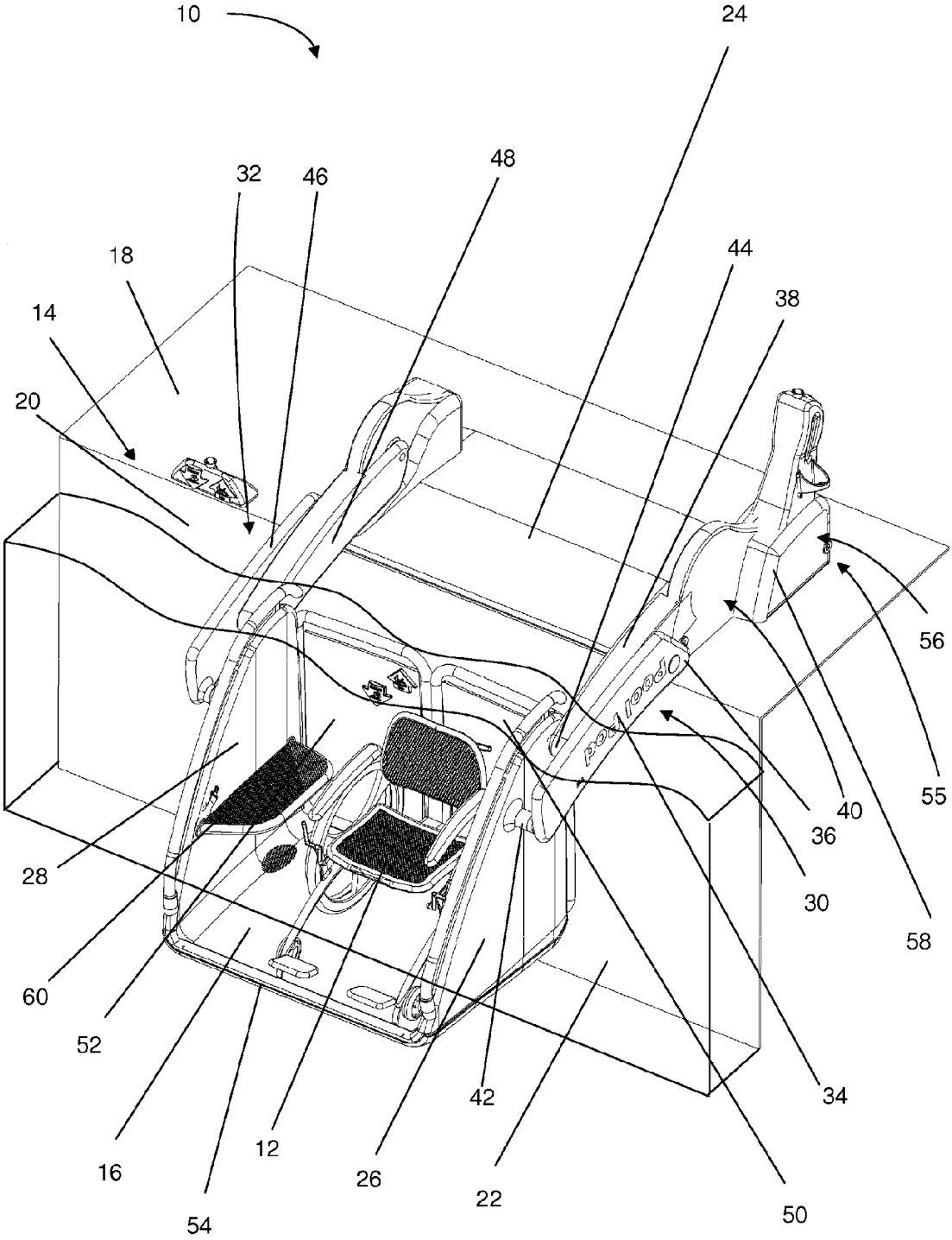
FIG. 3 is a representation of the lifting apparatus of FIG. 1 in a lowered configuration.

Reference is first made to FIGS. 1 to 3 in which there is shown a lifting apparatus 10 in accordance with an embodiment of the present invention for use in raising a user in a wheelchair 12 in a pool 14. The apparatus 10 comprises a wheelchair platform 16 for receiving the wheelchair 12, with apparatus shown in a storage configuration in FIG. 1; in a raised configuration in FIG. 2; and in a lowered configuration in FIG. 3.

In each of the configurations shown in FIGS. 1 to 3, and during reconfiguration of the apparatus 10 between each of the configurations shown, the platform 16 is maintained in a substantially horizontal orientation. By maintaining the platform 16 in a substantially horizontal orientation, the user in the wheelchair 12 can be stably moved on the platform 16.

In the storage configuration, the platform 16 is positioned adjacent the pool 14 at a poolside 18, with the platform 16 aft of a poolwall 20 such that no portion of the platform 16 overhangs a body of water 22 in the pool 14. With the platform 16 in the storage configuration, users in the pool 14 can use the pool 14 largely unimpeded, including using the poolwall 20 (and poolwall edge 21). Accordingly, the entire body of water 22 in the pool 14 may be used unimpeded when the platform 16 is in the storage configuration. In the embodiment shown, a level of water 22 in the pool 14 is below the poolside 18; however in other embodiments, the level of water 22 may be higher or lower with respect to the poolside 18: for example, the poolside 18 may determine the level of water 22 in the pool 14.

The apparatus 10 has a base 24 that is fixed to the poolside 18. In the storage configuration, the platform 16 is positioned above the base 24. A footprint of the platform 16 overlaps a footprint of the base 24. Accordingly, the apparatus 10 has a reduced total footprint in the storage configuration, determined by the larger of the platform 16 or the base 24. The total footprint is entirely adjacent the poolside 18 such that no portion of the apparatus overhangs the body of water 22 in the pool 14 in the storage configuration. The platform 16 is connected to the base 24 via a first and a second platform support 26, 28. The platform supports 26, 28 are located either side of the platform 16 such that a central portion of the platform 16 between the platform supports 26, 28 is accessible to the wheelchair 12. The platform supports 26, 28 are connected to the base 24 via respective first and second linkage assemblies 30, 32.

The first linkage assembly 30 comprises a first link arm 34 connected to the base 24 at a first link arm base pivot 36. The first linkage assembly comprises a second link arm 38 connected to the base 24 at a second link arm base pivot 40. The first link arm 34 is connected to the platform support 26 at a first link arm platform support pivot 42. The second link arm 38 is connected to the platform support 26 at a second link arm platform support pivot 44. The first and second link arms 34, 38 have a similar effective length such that a separation between the first link arm base pivot 36 and the first link arm platform support pivot 42, and a separation between the second link arm base pivot 40 and the second link arm platform support pivot 44, is substantially the same. A separation between the first link arm base pivot 36 and the second link arm base pivot 40, and a separation between the first link arm platform support pivot 42 and the second link arm platform support pivot 44, is substantially the same. Accordingly the pivots 36, 40, 42, 44 of the first linkage assembly 30 define pivots of a parallelogram-shaped four bar mechanism.

As the base pivots 36, 40 are fixed relative to the base, the orientation of the first platform support 26 is fixed relative to the base throughout the movement of the first linkage assembly 30. The platform 16 is rigidly connected to the platform support 26 such that there is no relative rotation between the platform 16 and the platform support 26. Accordingly, the orientation of the platform 16 is fixed relative to the base throughout the movement of the first linkage assembly 30.

The features of the first linkage assembly 30 are generally analogous to the second linkage assembly 32; the second linkage assembly 32 being substantially a mirror image of the first linkage assembly 30. Accordingly, the the second linkage assembly 32 comprises third and fourth link arms 46, 48, corresponding to the first and second link arms 34, 38 respectivley; each link arm 34, 38 connecting the base 24 and the second platform support 28. Providing a platform support 26, 28 either side of the platform 16 permits improved stability of the platform 16; and permits reduced deformation due to loads on the platform 16, such as bending or twisting.

A pair of hinged gates 50, 52 restricts access to the platform 16, with the gates 50, 52 being locked shut in the storage configuration of FIG. 1. The apparatus 10 further comprises a pool barrier 54 configured to prevent the wheelchair 12 exiting a front of the platform 16, such as by undesired axial movement of the wheelchair 12 relative to the platform 16. The apparatus 10 is configured such that the axial position of the wheelchair 12 on the platform is effectively fixed when the gates 50, 52 are in a shut position. That is, a rear of the wheelchair 12 abuts the gates 50, 52 and a front of the wheelchair 12 abuts the pool barrier 54, when the gates 50, 52 are closed. The pool barrier 54 comprises a first wheelchair interface such that the wheelchair 12 is restrained from movement by the pool barrier 54. The first wheelchair interface is configured to restrain axial, lateral and/or vertical movement of the wheelchair 12 relative to the platform 16, when the wheelchair 12 abuts the pool barrier 54. The pair of gates 50, 52 comprises a second wheelchair interface such that the wheelchair 12 is restrained from movement by the gates 50, 52. The second wheelchair interface is configured to restrain axial, lateral and/or vertical movement of the wheelchair 12 relative to the platform 16, when the wheelchair 12 abuts the pool barrier 54. The apparatus 10 is configured such that the wheelchair 12 simultaneously abuts the pool barrier 54 and the gates 50, 52 when the gates 50, 52 are shut. Accordingly, the wheelchair 12 is fixed relative to the platform 16 when the gates 50, 52 are shut. As the wheels of the wheelchair 12 are axially aligned when the wheelchair 12 is positioned on the platform 16 when the gates 50, 52 are shut, the wheelchair 12 is prevented from laterally rolling. Although shown in FIG. 1 with the wheelchair 12 located on the platform 16 in the storage configuration, it will be appreciated that the wheelchair 12 may be positioned remotely from the apparatus 10 in the storage configuration (e.g. to transport the user to the apparatus 10). The apparatus 10 is shown in FIG. 2 in a raised configuration, with the platform 16 positioned over the body of water 22. The apparatus 10 is moved from the stored configuration of FIG. 1 to the raised configuration of FIG. 2 upon an instruction from a user (not shown). The user has an activation member (not shown) containing identity information, such as a wristband with RFID. The apparatus 10 comprises a control system that is connected to a management system, such as a programmable computer-controlled data management system. Detection of the activation member by the apparatus 10 and verification of authorisation of the associated user identity enables the apparatus 10 to be rendered operable; and deployed from the storage configuration to the raised configuration. The apparatus 10 activates a first drive system 55 with a motor 56 to power the first linkage assembly 30 via a gearbox 58. Accordingly, the platform 16 swings through an arc defined by the parallelogram four bar mechanism of the first linkage system 30 from the storage configuration to the raised configuration. The platform 16 remains substantially horizontal throughout movement between the configurations.

From the raised configuration shown in FIG. 2, activation of the apparatus 10 causes the gates 50, 52 to unlock and automatically open. The apparatus 10 comprises motors to actively open the gates 50, 52 that swing open rearwards, away from the pool 14. With the gates 50, 52 open, the platform 16 is accessible for the wheelchair 12, allowing the user to enter or exit the platform 16. When entering the pool 14, the user moves the wheelchair 12 forwards from the poolside 18, over a portion of the base 24 onto the platform 16, the base 24, platform 16 and poolside 18 all being substantially of the same elevation with the apparatus 10 in the raised configuration. The gates 50, 52 are closed behind the wheelchair 12, pressing against the rear of the wheelchair 12 such that the wheelchair 12 is pressed against the pool barrier 54 at the front of the platform 16. Thereby, the wheelchair 12 is aligned on the platform 16 such that the rear of the wheelchair 16 is restrained by the gates 50, 52; and the front of the wheelchair 12 is restrained be the pool barrier 54. The gates 50, 52 are configured to close only when the wheelchair 12 is correctly aligned on the platform 16.

The gates 50, 52 are configured to be unable to close completely when the wheelchair 12 is incorrectly aligned on the platform 16. A gate sensor detects when the gates 50, 52 are completely shut; and a lock is automatically deployed when the gate sensor detects that the gates 50, 52 are completely shut. Accordingly, the gates 50, 52 are locked shut when the apparatus 10 detects that the wheelchair 12 is correctly aligned on the platform 16. With the gates 50, 52 locked shut, the wheelchair 12 is restrained on the platform by the gates 50, 52 and by the pool barrier 54. When the apparatus 10 determines that the gates 50, 52 are locked shut behind the wheelchair 12 on the platform 16, the apparatus 10 is operable to move to the lowered configuration of FIG. 3. The configuration shown in FIG. 2 is suitable for a user entering or exiting the pool 14; and is also suitable for an empty wheelchair 12 to be deployed into or removed from the pool 14. Although shown with a wheelchair 12, the apparatus 10 can be used by users without a wheelchair 12. The apparatus 10 has a seat 60 for accommodating a sitting user—who may otherwise have difficulty entering or exiting the pool 14.

With the wheelchair 12 secured on the platform 16 in the raised configuration of FIG. 2, the apparatus 10 can be moved to the lowered configuration of FIG. 3. Upon instruction from the authorised user, the motor 56 is activated to drive the first linkage assembly 30 via the gearbox 58. Accordingly, the platform 16 swings through an arc defined by the first linkage assembly 30 from the raised configuration to the lowered configuration. The apparatus 10 monitors the relative position of the platform 16, such that drive from the motor 56 is ceased when the platform 16 reaches an intended position. The user is able to control the apparatus 10 to determine when the motor 56 ceases. In the embodiment shown, the apparatus 10 has an operation sensor to detect the proximity of the activation member such that the apparatus stops movement of the platform 16 when the user removes the activation member from the vicinity of the operation sensor (e.g. the user moves their wrist with the wristband away from the operation sensor). Accordingly the activation member can function as a dead man's switch.

The apparatus 10 is adjustable to define an intended position. For example, the apparatus may be programmed to define the lowered configuration dependent upon a particular circumstance of the pool 14, such as a restricted depth of the pool 14. The apparatus can be programmed to define the intended position dependent upon the user (e.g. the lowered configuration can define a lower position in the body of water 22 for a taller user than for a shorter user).

During lowering from the raised configuration of FIG. 2 to the lowered configuration of FIG. 3, the platform 16 is submerged in the body of water 22. The platform 16 is configured to channel a flow of water such that a resistance to movement of the platform 16 through the body of water 22 is reduced. The pool barrier 54 and the gates 50, 52 restrain the wheelchair 12 such that an effect of buoyancy of the wheelchair 12 in the body of water 22 does not displace the wheelchair 12 relative to the platform 16. Once in the lowered configuration of FIG. 3, the user is able to dismount the wheelchair 12 into the body of water 22: buoyancy provided by the body of water 22 aiding in supporting the user.

The user is able to exit the pool 14 by substantially reversing the process between FIGS. 2 and 3: mounting the wheelchair 12 in the configuration of FIG. 3; and activating the motor 56, raising the platform to the raised configuration of FIG. 2. The apparatus 10 is configured not to unlock the gates 50,52 when the platform 16 is located in the lowered configuration, or located in between the raised and lowered configurations. Accordingly, the user can only dismount the platform 16 on the wheelchair 12, once the platform 16 is returned to the raised configuration of FIG. 2; thus ensuring the wheelchair 12 remains safely on the platform 16 during raising and lowering. It will be appreciated that in between the user dismounting the platform 16 into the pool from the lowered configuration, and the user re-mounting the platform 16 in the lowered configuration to exit the pool 14, that the platform can be returned to the raised configuration of FIG. 2, or the storage configuration of FIG. 3. Accordingly, the body of water 22 can be made available for unimpeded use when the use of the apparatus 10 is not required.

Figure 4:
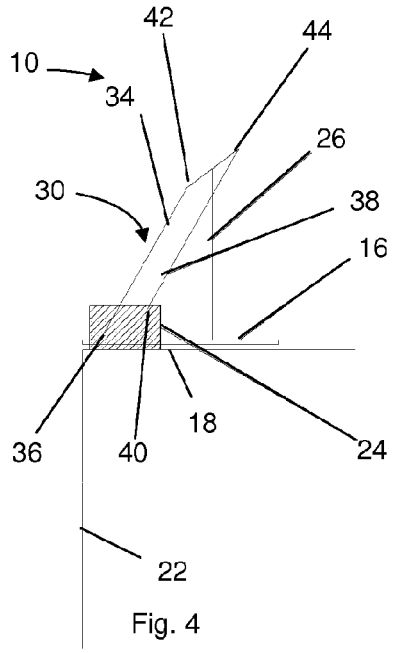
FIG. 4 is a schematic representation of a first linkage assembly of the lifting apparatus of FIG. 1 in the storage configuration.
Figure 6:
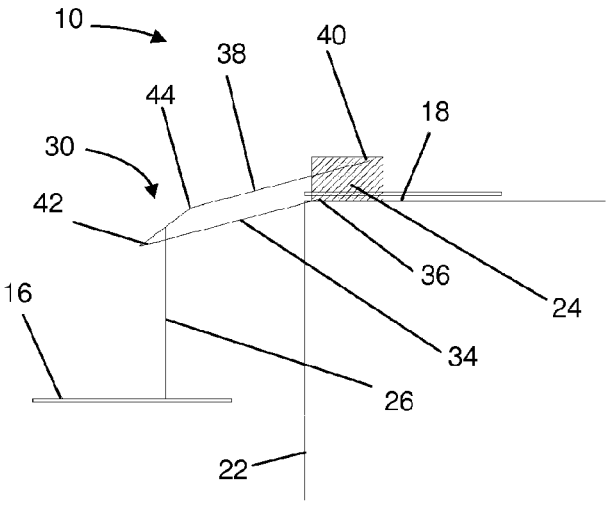
FIG. 6 is a schematic representation of the first linkage assembly of the lifting apparatus of FIG. 1 in the lowered configuration.
Figure 5:
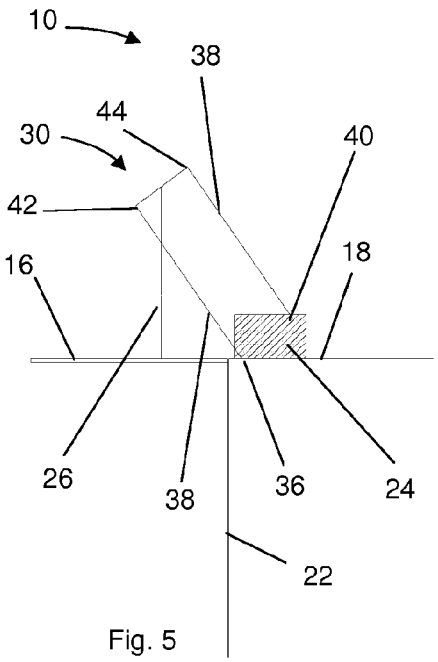
FIG. 5 is a schematic representation of the first linkage assembly of the lifting apparatus of FIG. 1 in the raised configuration.
Figure 7:
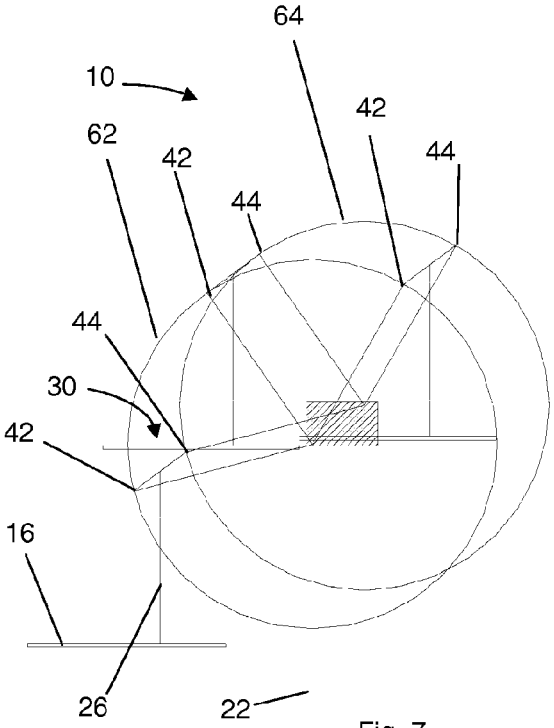
FIG. 7 is a combined schematic side representation of the first linkage system of FIGS. 4 to 6, indicating respective paths of first and second link arm platform support pivots.

FIGS. 4 to 6 show schematic side representations of the four bar mechanism defined by the first linkage system 30 of the apparatus 10 of FIG. 1 in the storage, raised and lowered configurations respectively. FIG. 7 shows a combined schematic side representation of the first linkage system 30 of FIGS. 4 to 6, with arcs 62, 64 indicating respective paths of the first and second link arm platform support pivots 42, 44. The four bar mechanism is a parallelogram with the first and second link arms 34, 38 being of an equal effective first length; and the first platform support 26 and the base 24 being of equal effective second length. As the positions of the first and second link arm base pivots 36, 40 are fixed, and the four bar mechanism is a parallelogram, the relative position of the first and second link arm platform support pivots 42, 44 remains the same throughout reconfiguration of the apparatus 10. As the platform 16 is fixed relative to the first platform support 26, the orientation of the platform 16 remains the same (i.e. always substantially horizontal) throughout reconfiguration. As can be seen clearly in FIG. 5, the platform 16 has substantially the same elevation as the base 24 on the poolside 18 with no substantial separation therebetween, such that the wheelchair 12 can be easily rolled between the platform 16 and the poolside 18 via the base 24 in the raised configuration. A flexible portion at the rear of the platform 16 provides scope for a flush abutment of the platform 16 with the base 24 or poolside 18.

Figure 8:
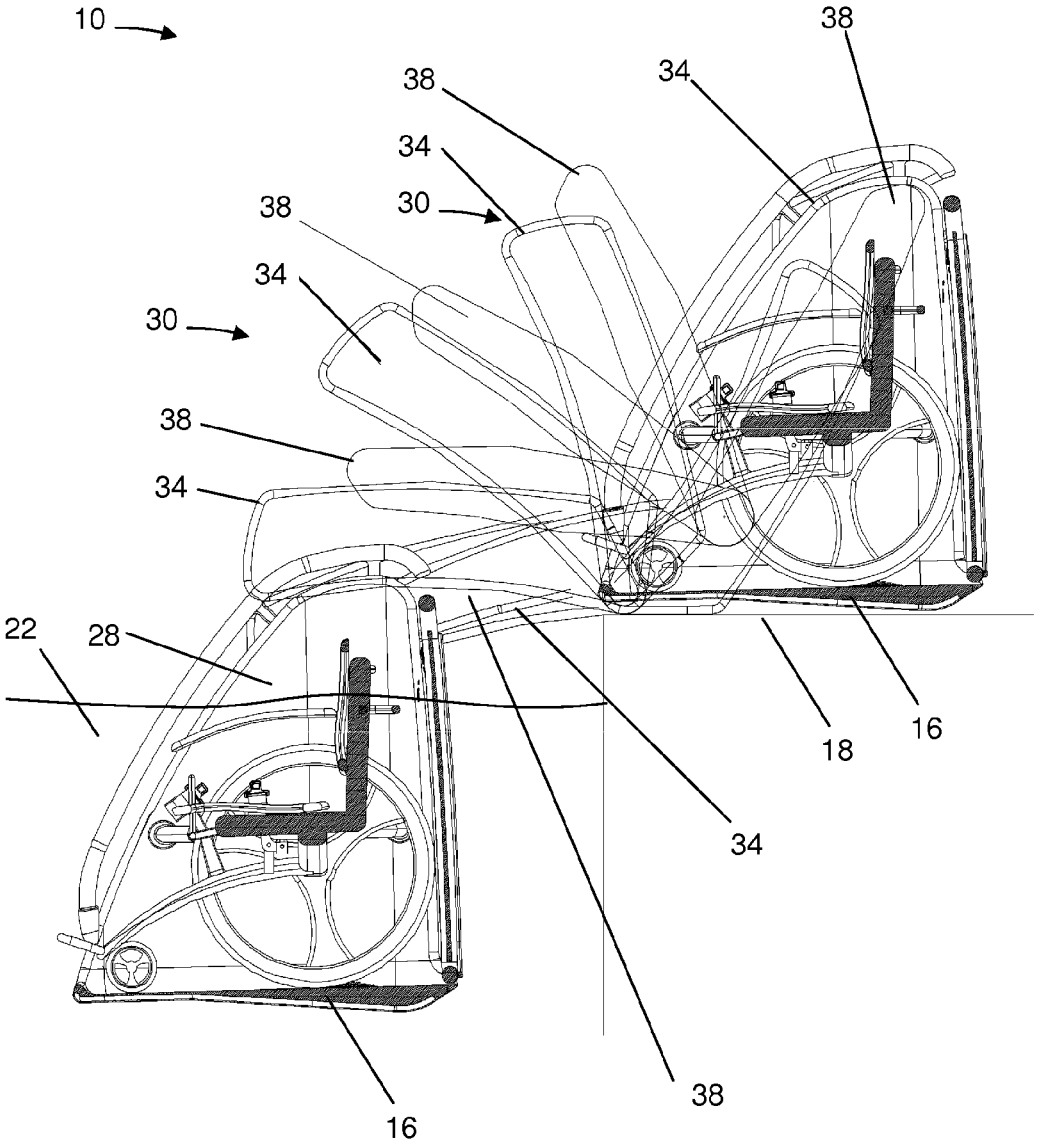
FIG. 8 is a schematic sectional side view of the apparatus of FIG. 1, with the apparatus depicted in storage and lowered configurations.

FIG. 8 shows a schematic sectional side view of the apparatus of FIG. 1, with the apparatus depicted in both the storage and lowered configurations. Further, the first linkage assembly 30 is depicted in a number of intermediate configurations. The first and second link arms 34, 38 are formed and arranged such that there is no gap between the two 34, 38 when viewed from the side as in FIG. 8. That is the first and second link arms 34, 38 always overlap in all configurations of the apparatus 10, when viewed from the side (perpendicular to a plane of movement). The first and second link arms 34, 38 are each positioned in adjacent planes parallel to the section of FIG. 8 such that there is a minimal horizontal separation between the first and second link arms 34, 38. Accordingly, a risk of trapping an object, such as a body part, in the first linkage system 30 is reduced.

Figure 9:
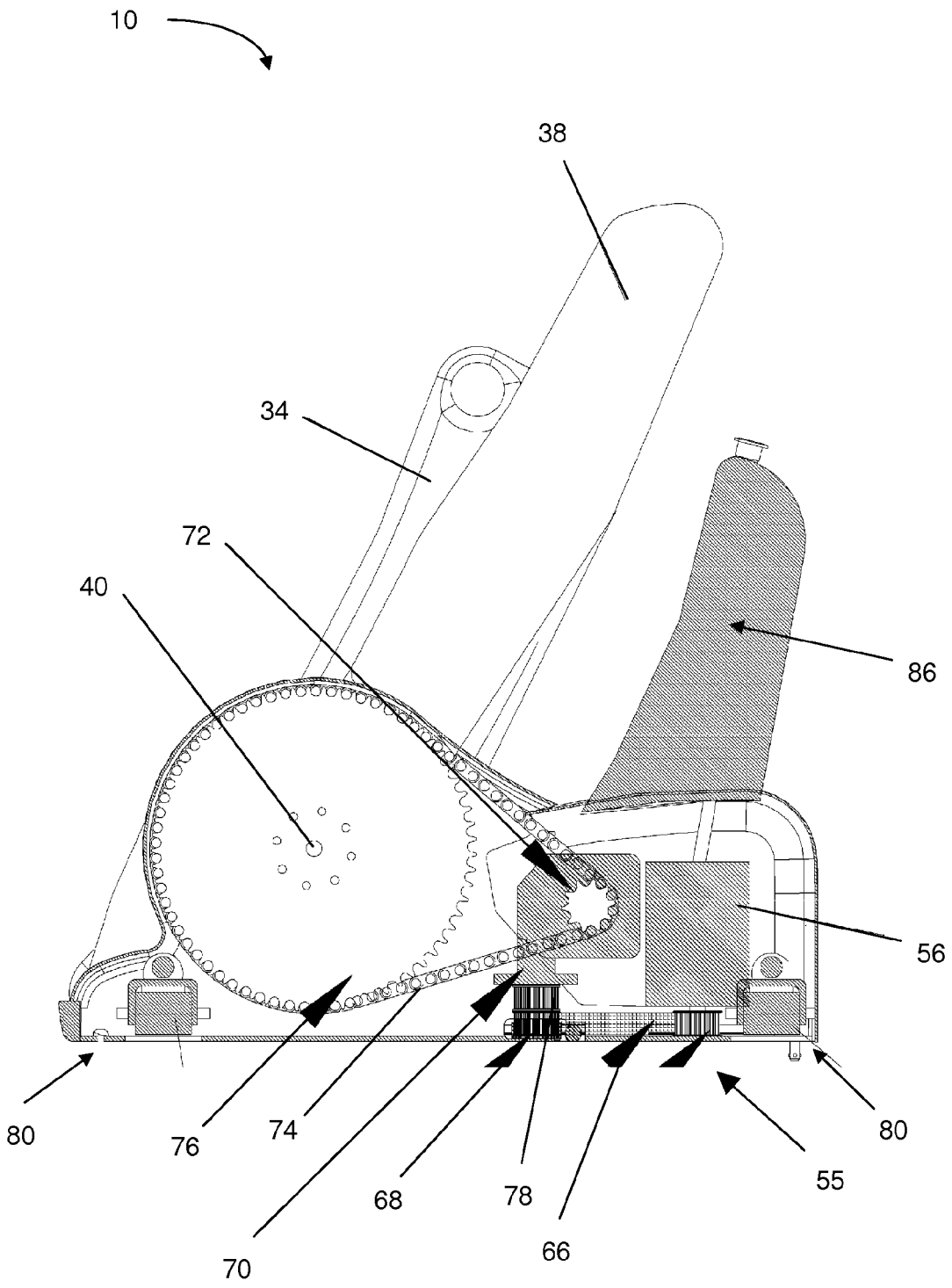
FIG. 9 is a schematic representation of a drive system of the apparatus of FIG. 1.

FIG. 9 shows a schematic representation of the first drive system 55 of the apparatus 10 of FIG. 1 for transferring drive from the motor 56 to the second link arm 38. In the embodiment shown, the first drive system 55 includes: a first pulley system 66, a first input shaft 68, a first worm drive gearbox 70, a first driving gear 72, a first chain drive 74 and a first driven gear 76. The first driven gear 76 is rigidly connected to the second link arm 38, such that a rotation of the first driven gear 76 causes the second link arm 38 to rotate: altering the position of the first linkage assembly 30 and the associated platform 16.

A timing belt 78 is connected to the first input shaft 68 such that drive is transmitted from the motor 56 to a second drive system. The second drive system is connected to the second linkage system 32 such that the motor 56 drives the first and second linkages systems 30, 32 simultaneously. The second drive system comprises similar features to the first drive system 55. Accordingly, the fourth link arm 48 is rigidly connected to a second driven gear. Bolts 80 are shown for attaching the apparatus 10 to the poolside 18.

Figure 10:
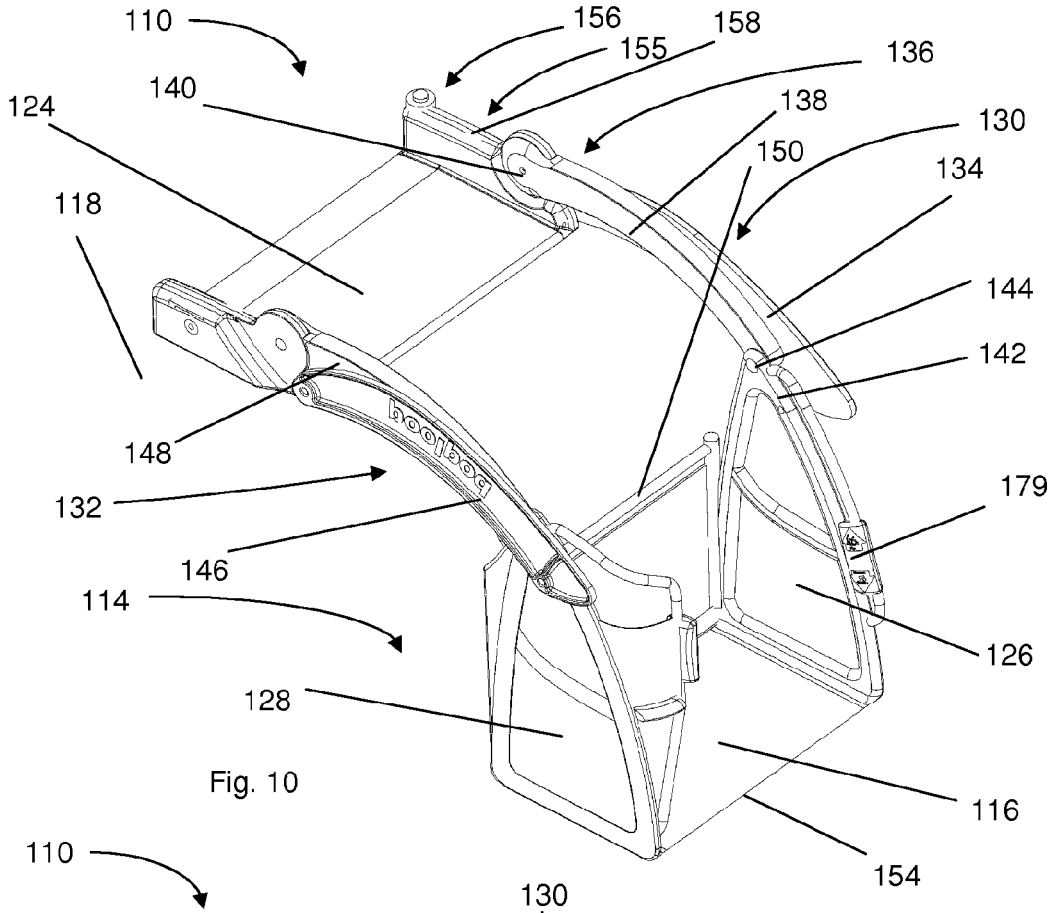
FIG. 10 shows an apparatus according to an alternative embodiment of the invention, for use in raising a user in a wheelchair in a body of water.
Figure 11:
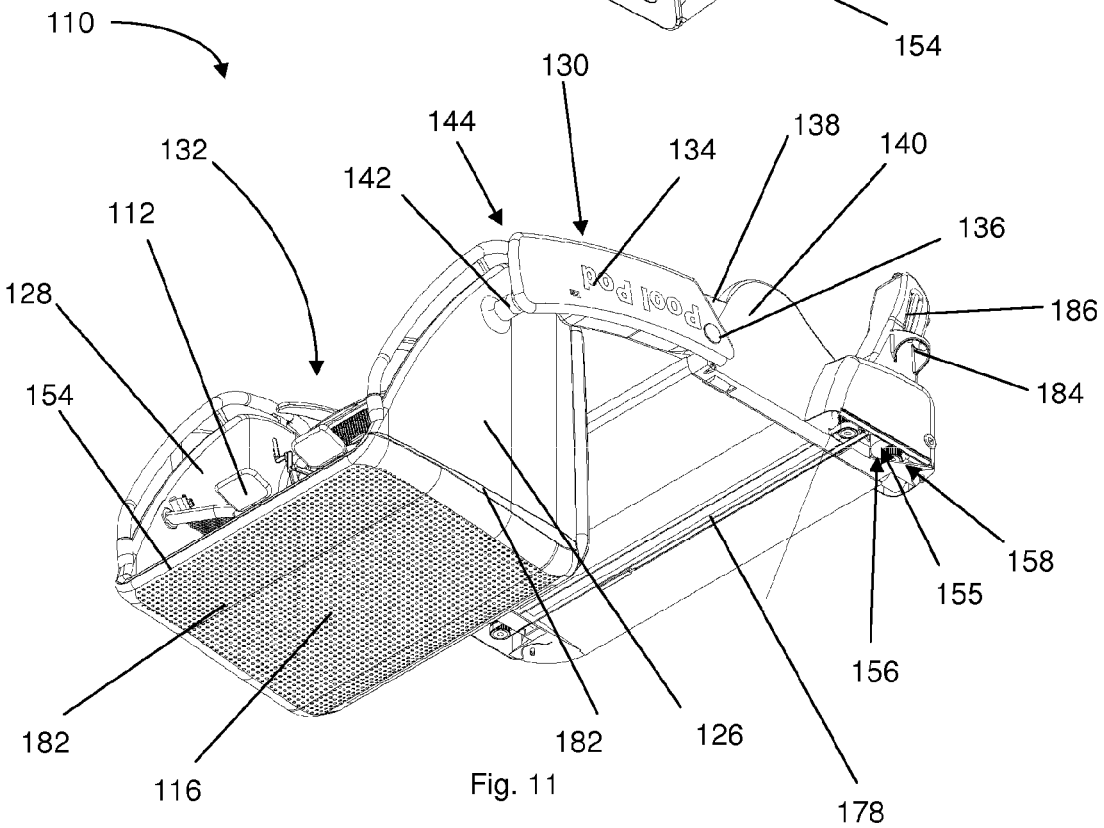

FIGS. 10 and 11 show an apparatus 110 according to an alternative embodiment of the invention, for use in raising a user in a wheelchair 112 in a pool 114. The apparatus 110 generally comprises similar features to the apparatus 10 of FIG. 1, incremented by 100. Accordingly, the apparatus 110 comprises a platform 116. The apparatus comprises a single hinged gate 150 for controlling access to the platform 116, and for monitoring whether the wheelchair 112 is correctly positioned on the platform 116 to allow for safe reconfiguration of the apparatus 110. A control panel 179 is provided for the user to control the operation of the apparatus 110 from the platform 116. FIG. 10 shows the underside of the platform 116 to which obstruction sensors 182 are mounted. The obstruction sensors 182 monitor whether an intended path of the platform 116 is potentially obstructed and send a signal to an apparatus control system that arrests the movement of the platform 116. The apparatus 110 issues an audio alert, and a visual alert such that the user is alerted to the obstruction. Accordingly, a trapping of objects between the platform 116 and a poolwall 120 is prevented. Similarly, a collision of the platform 116 (e.g. a collision of the platform with a swimmer in the body of water 122) is prevented by the obstruction sensors 182. A crutch holder 184 is provided for storing crutches, such as when the user is in the pool 114. A manual handle 186 is provided as an alternative power source, such as for use in an emergency (e.g. if power to the motor 156 fails). The manual handle 186 is engageable with a drive system 155 to reconfigure the apparatus if necessary.

Figure 12:
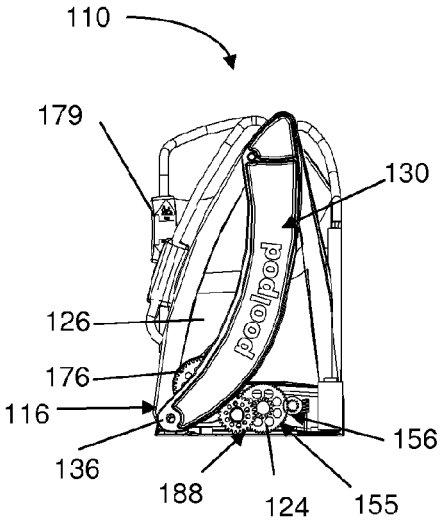
FIG. 12 shows the apparatus of FIG. 10 with a drive system exposed, with the apparatus in a storage configuration.
Figure 13:
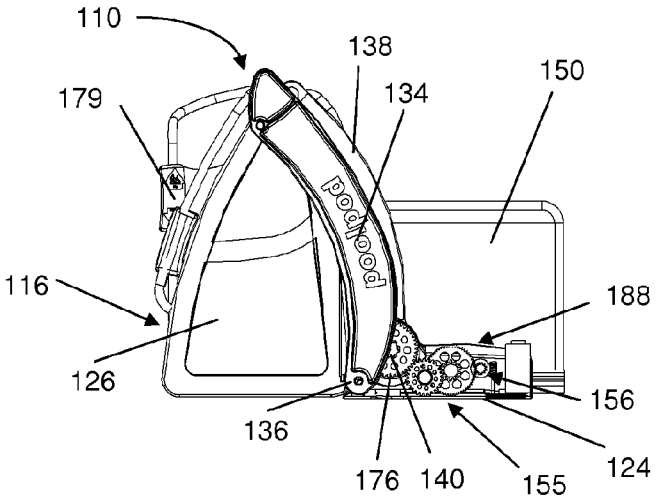
FIG. 13 shows the apparatus of FIG. 10 with the drive system exposed, with the apparatus in a raised configuration.
Figure 14:
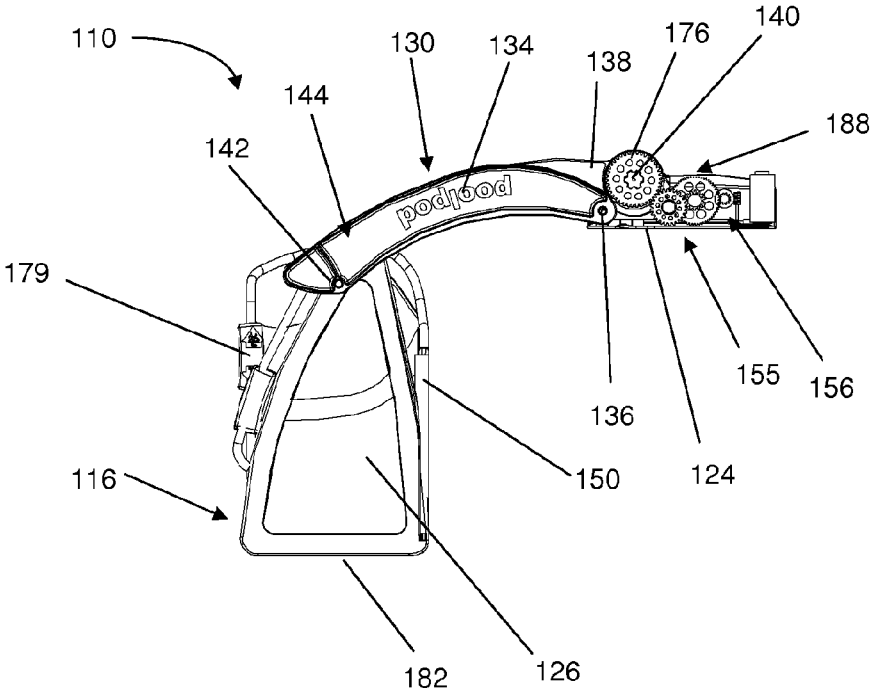
FIG. 14 shows the apparatus of FIG. 10 with the drive system exposed, with the apparatus in a lowered configuration.

FIGS. 12 to 14 show the apparatus 110 of FIG. 10 with the drive system 155 exposed. The drive system 155 comprises a series of sprockets 188 that connect a second link arm 138 to a motor 156. FIG. 12 shows the apparatus 110 in a storage configuration, with the platform 116 located above the base 124 such that the apparatus 110 occupies a reduced footprint and has a compact profile. Accordingly, the apparatus 110 may be easily transported in the storage configuration. FIG. 13 shows the apparatus 110 in a raised configuration with the gate 150 open to allow access between the poolside 118 and the platform 116. FIG. 14 shows the apparatus 110 in a lowered configuration, such that the platform 116 can be fully submerged in a body of water.

Figure 15:
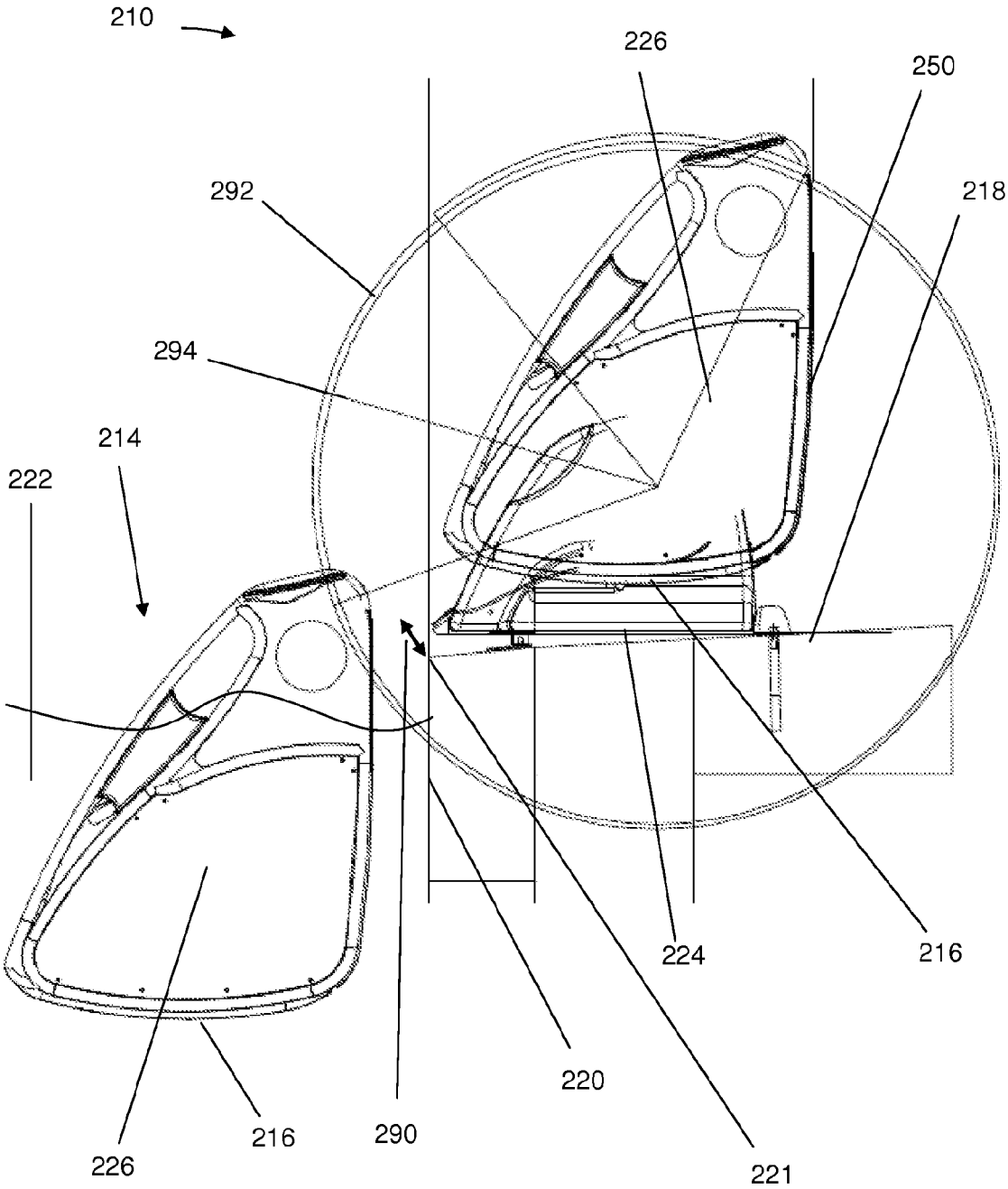
FIG. 15 shows an apparatus according to an alternative embodiment of the invention, for use in raising a user in a wheelchair in a body of water, with the apparatus depicted in storage and lowered configurations.

FIG. 15 shows an apparatus 210 according to an alternative embodiment of the invention, for use in raising a user in a wheelchair 212 in a pool 214. The apparatus 210 generally comprises similar features to the apparatus 110 of FIG. 10, incremented by 100. Accordingly, the apparatus 210 comprises a platform 216. Some features have been omitted for clarity, such as the linkage system. The platform 216 comprises a profiled cross-section with a reduced front-to-back span such that the relative clearance 290 between the platform and the edge 221 of the poolwall 220 during reconfiguration would be increased compared to the embodiment of FIG. 12. However, the potentially increased clearance 290 has been utilised in the embodiment of FIG. 15 to provide a reduced radius arcuate path 292, maintaining a similar clearance 290 as the embodiment of FIG. 10. The arcuate path 292 illustrates the motion of the platform 216 between the storage (shown), raised (not shown in FIG. 15) and lowered (shown) configurations about a central virtual pivot point 294. The similar clearance 290 can help prevent objects (e.g. limbs) being pinched between the platform 216 and poolwall 220 edge 221 (as may be more likely with a larger clearance 290). The reduced arcuate path 292 provides for a more compact apparatus 210 and reduced forces. The reduced span of the platform 216 has been partially enabled by the adaptation of the gate 250 to include a profiled lower portion 294 that assists in retaining a wheelchair (not shown) to the platform 216, whilst limiting a possibility of protrusion (e.g. of objects, limbs, etc) from the platform 216 at the clearance 292 with the edge 221 of the poolwall 220.

Figure 16:
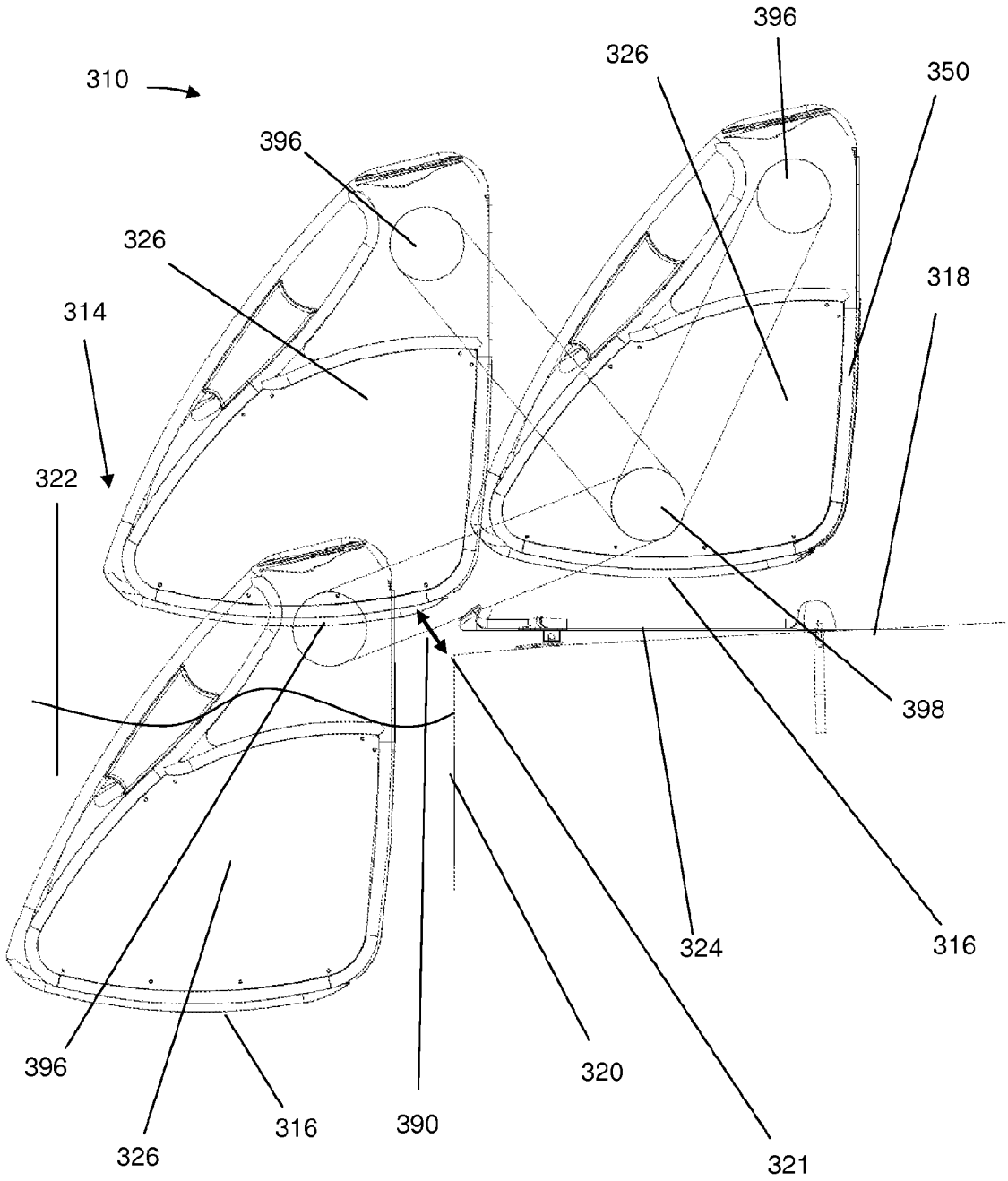
FIG. 16 shows an apparatus according to an alternative embodiment of the invention, for use in raising a user in a wheelchair in a body of water, with the apparatus depicted in raised, storage and lowered configurations.

FIG. 16 shows an apparatus 310 according to an alternative embodiment of the invention, for use in raising a user in a wheelchair 312 in a pool 314. The apparatus 310 generally comprises similar features to the apparatus 210 of FIG. 15, incremented by 100. Accordingly, the apparatus 310 comprises a platform 316. The apparatus comprises a pair of sprockets 396, 398 connected by a chain 399. One of the sprockets (the platform support sprocket 396 in the embodiment shown) is fixed and the other sprocket (the base sprocket 398 in the embodiment shown) is controllably rotatable such that the chain 399 and sprockets 396, 398 serve to maintain the platform 316 in a substantially horizontal orientation during reconfiguration.

In the embodiment shown in FIG. 16, the apparatus 310 comprises a single chain 399 and pair of sprockets 396, 398 on one side of the platform 316. In an alternative embodiment (not shown), an apparatus comprises a pair of sprockets and chain on each side of the platform.

It should be understood that the embodiments described herein are merely exemplary and that various modifications may be made thereto without departing from the scope of the invention. For example, where the wheelchair is shown here in a pool-facing orientation in all configurations, the apparatus may be configured to receive the wheelchair in alternative orientations: such as always in a rear-facing orientation, or in a configuration-dependent orientation (e.g. pool-facing during lowering and rear-facing during raising). The skilled person will appreciate that features associated with one embodiment may be applicable to another embodiment. For example, the obstruction sensors of apparatus 110 of FIG. 10 may be incorporated into an apparatus with selected features of the apparatus 10 of FIG. 1.

Although shown here with a low pool barrier 54 relative to the gates 50, 52, the apparatus may comprise a higher pool barrier, such as a gate or pair of gates with similar features as the gates 50, 52 at the rear of the platform (the front gate controlling access to/form the pool 14, as opposed to to/from the poolside 18). The higher pool barrier may provide more security and/or perception of security during movement between the raised and lowered configurations. Although shown here for accessing a pool, the lifting device may be suitable for use in other locations, such as accessing a vehicle, or accessing a raised or a lowered floor level.

The invention claimed is:

1. A lifting apparatus for raising a user in a body of water, the lifting apparatus comprising:

a base configured to be attached to a surface adjacent to the body of water;

a platform configured to receive a wheelchair; and at least one linkage assembly pivotally connecting the platform to the base; wherein the platform is movable relative to the base and the body of water via the at least one linkage assembly;

wherein the at least one linkage assembly is operable to move the platform between:

a raised configuration, wherein the platform is substantially horizontal and is positioned over the body of water;

a lowered configuration, wherein the platform is substantially horizontal and is submerged in the body of water; and a storage configuration, wherein the platform is substantially horizontal and rests over the base, and wherein the platform is substantially clear of the body of water;

wherein the at least one linkage assembly is configured to maintain the platform in a substantially horizontal orientation when moving between the raised, lowered and storage configurations;

wherein the at least one linkage assembly is configured to move the platform along a substantially continuous path between the storage and raised and lowered configurations; and wherein the path is defined substantially in a single plane.

2. A method of raising a user from a body of water, the method comprising:

the user accessing a platform of a lifting apparatus in a lowered configuration;

maintaining the platform in a substantially horizontal orientation using at least one linkage assembly;

using the at least one linkage assembly to reconfigure the apparatus to a raised configuration, wherein the platform is positioned over the body of water and adjacent to a base attached to a surface adjacent to the body of water;

the user exiting the platform in the raised configuration;

using the at least one linkage assembly to reconfigure the apparatus to a storage configuration, wherein the platform rests over the base attached to the surface adjacent to the body of water, and wherein the platform is substantially clear of the body of water;

using the at least one linkage assembly to maintain the platform in the horizontal orientation when moving the platform between the raised, lowered and storage configurations; and using the at least one linkage assembly to move the platform between the storage and raised and lowered configurations along a substantially continuous path, wherein the path is defined substantially in a single plane.

3. The method of claim 2, further comprising at least partially submerging the platform in the lowered configuration.

4. The apparatus of claim 1, wherein the at least one linkage assembly comprises provides a first linkage assembly comprising:

a platform support member;

a first link arm connected to the base at a first link arm base pivot, and connected to the platform support member at a first link arm platform pivot; and a second link arm connected to the base at a second link arm base pivot, and connected to the platform support member at a second link arm platform pivot;

such that the first linkage assembly defines four pivot points;

wherein the first and second link arms define opposite sides of a quadrilateral representative of a four bar mechanism.

5. The apparatus of claim 4, wherein the first linkage assembly is configured such that the first and second link arms at least partially overlap when viewed in a horizontal plane.

6. The apparatus of claim 4, wherein the first linkage assembly is configured to overlap the first and second link arms such that there is no substantial vertical separation between the first and second link arms during reconfiguration between the raised and lowered configurations.

7. The apparatus of claim 4, wherein the apparatus comprises a second linkage assembly.

8. The apparatus of claim 7, wherein the apparatus is configured to synchronize movement of the first and second linkage assemblies.

9. The method of claim 2, further comprising activating the lifting apparatus with a remote activation member.

10. The method of claim 2, further comprising transferring the user onto a wheelchair on the platform in the lowered configuration.

11. The apparatus of claim 1, wherein the path is substantially non-linear.

12. The apparatus of claim 1, wherein the path is arcuate, such as a portion of a circle.

13. The apparatus of claim 1, wherein the apparatus comprises an entrance barrier, comprising a door or a gate hinged for pivotal movement about a substantially vertical axis, and wherein the entrance barrier provides an exit barrier configured to contact the wheelchair when the entrance barrier is closed and when the wheelchair is positioned on the platform.

14. The apparatus of claim 1, wherein the single plane is a substantially vertical plane.

15. The method of claim 2, wherein the single plane is a substantially vertical plane.

16. The lifting apparatus of claim 1, wherein the apparatus is configured to be inoperable when the wheelchair is incorrectly positioned on the platform.

17. The lifting apparatus of claim 1, wherein the platform defines a footprint that overlaps a footprint defined by the base, when the platform is oriented in the storage configuration.

* * * * *